US008544547B2

(12) United States Patent
Nguyen

(10) Patent No.: US 8,544,547 B2
(45) Date of Patent: Oct. 1, 2013

(54) FRAC SYSTEM SPLIT RING DEVICE

(75) Inventor: Dennis P. Nguyen, Pearland, TX (US)

(73) Assignee: Cameron International Corporation, Houston, TX (US)

( * ) Notice: Subject to any disclaimer, the term of this patent is extended or adjusted under 35 U.S.C. 154(b) by 272 days.

(21) Appl. No.: 12/745,687

(22) PCT Filed: Dec. 16, 2008

(86) PCT No.: PCT/US2008/087048

§ 371 (c)(1),
(2), (4) Date: Jun. 1, 2010

(87) PCT Pub. No.: WO2009/088674

PCT Pub. Date: Jul. 16, 2009

(65) Prior Publication Data

US 2010/0258295 A1 Oct. 14, 2010

Related U.S. Application Data

(60) Provisional application No. 61/019,142, filed on Jan. 4, 2008.

(51) Int. Cl.
*E21B 43/26* (2006.01)

(52) U.S. Cl.
USPC ..... 166/308.1; 166/177.5; 166/378; 166/86.1

(58) Field of Classification Search
USPC ..... 166/177.5, 86.1, 308.1, 378
See application file for complete search history.

(56) References Cited

U.S. PATENT DOCUMENTS

| | | | | |
|---|---|---|---|---|
| 4,552,213 | A * | 11/1985 | Boyd et al. | 166/88.4 |
| 5,490,565 | A * | 2/1996 | Baker | 166/379 |
| 6,920,925 | B2 * | 7/2005 | Duhn et al. | 166/75.13 |
| 7,322,407 | B2 | 1/2008 | Duhn et al. | |
| 7,416,020 | B2 | 8/2008 | Duhn et al. | |
| 2005/0284640 | A1 * | 12/2005 | Borak, Jr. | 166/369 |

OTHER PUBLICATIONS

PCT International Search Report and Written Opinion for PCTUS2008/087048, dated Jul. 24, 2009.

* cited by examiner

*Primary Examiner* — David Andrews
*Assistant Examiner* — Ronald Runyan
(74) *Attorney, Agent, or Firm* — Fletcher Yoder, P.C.

(57) ABSTRACT

A wellhead system, in an embodiment, includes a first wellhead component with an internal bore, and a second wellhead component with a lower end disposed within the first wellhead component internal bore and an upper end disposed outside of the first wellhead component internal bore. The upper end of the second wellhead component has a groove disposed on an outer surface thereof. The wellhead system also includes a retaining member with a plurality of sections, wherein a portion of the retaining member is at least partially disposed in the groove on the second wellhead component, the retaining member is coupled to the first wellhead component, and an anti-rotation mechanism engages both the retaining member and the second wellhead component.

19 Claims, 4 Drawing Sheets

FRAC SYSTEM SPLIT RING DEVICE

CROSS-REFERENCE TO RELATED APPLICATIONS

This application claims priority to and benefit of PCT Patent Application No. PCT/US2008/087048, entitled "FRAC System Split Ring Device," filed Dec. 16, 2008, which is herein incorporated by reference in its entirety, and which claims priority to and benefit of U.S. Provisional Patent Application No. 61/019,142, entitled "FRAC System Split Ring Device", filed on Jan. 4, 2008, which is herein incorporated by reference in its entirety.

FIELD OF THE INVENTION

The present invention relates generally to wellhead assemblies. More particularly, the present invention, in accordance with certain embodiments, relates to a novel coupling system for securing various components of wellhead assemblies to one another.

BACKGROUND

This section is intended to introduce the reader to various aspects of the art that may be related to various aspects of the present invention, which are described and/or claimed below. This discussion is believed to be helpful in providing the reader with background information to facilitate a better understanding of the various aspects of the present invention. Accordingly, it should be understood that these statements are to be read in this light, and not as admissions of prior art.

As will be appreciated, oil and natural gas have a profound effect on modern economies and societies. Indeed, devices and systems that depend on oil and natural gas are ubiquitous. For instance, oil and natural gas are used for fuel in a wide variety of vehicles, such as cars, airplanes, boats, and the like. Further, oil and natural gas are frequently used to heat homes during winter, to generate electricity, and to manufacture an astonishing array of everyday products.

In order to meet the demand for such natural resources, companies often invest significant amounts of time and money in searching for and extracting oil, natural gas, and other subterranean resources from the earth. Particularly, once a desired resource is discovered below the surface of the earth, drilling and production systems are often employed to access and extract the resource. These systems may be located on shore or offshore, depending on the location of a desired resource. Further, such systems generally include a wellhead assembly though which the resource is extracted. These wellhead assemblies may include a wide variety of components, such as various casings, hangers, valves, fluid conduits, and the like, that control drilling and/or extraction operations. Additionally, such wellhead assemblies may also include components, such as an isolating mandrel ("frac mandrel") and/or fracturing tree, to facilitate a fracturing process.

As will be appreciated, resources such as oil and natural gas are generally extracted from fissures or other cavities formed in various subterranean rock formations or strata. To facilitate extraction of such resources, a well may be subjected to a fracturing process that creates one or more man-made fractures in a rock formation. These man-made fractures then connect to a number of pre-existing or natural fissures and cavities, improving the dividend from the well. Such fracturing processes typically include injecting a fluid and carbon dioxide slurry into the well and well formation. The pressure of the fracturing fluids, however, may be greater than the pressure rating of certain components of a wellhead assembly. Moreover, the fracturing fluid may be abrasive.

Consequently, a frac mandrel is often utilized in such cases to isolate one or more lower-rated components from the fracturing pressure and fluid. A frac mandrel is typically inserted within a bore of the wellhead assembly and includes a body having a fluid passageway. This body isolates the lower-rated components from the pressure of the fracturing fluid injected into the well via the fluid passageway. Once the fracturing process is completed, the frac mandrel and other fracturing components may be removed from the wellhead assembly, and traditional production components, such as a "Christmas tree," may be coupled to the assembly. (A "Christmas tree" is an assembly of valves generally used to control production fluids from the well.)

SUMMARY

Certain aspects commensurate in scope with the originally claimed invention are set forth below. It should be understood that these aspects are presented merely to provide the reader with a brief summary of certain forms the invention might take and that these aspects are not intended to limit the scope of the invention. Indeed, the invention may encompass a variety of aspects that may not be set forth below.

Exemplary embodiments of the present invention generally relate to a novel system and method for coupling wellhead components to one another. In certain embodiments, wellhead components, such as frac mandrels, tubing spools, or the like, are coupled together via a split retaining ring assembly. In an exemplary embodiment, the split retaining ring assembly is connected around the frac mandrel so that a portion of the split retaining ring is at least partially disposed within a groove on the frac mandrel. An exemplary embodiment further comprises at least one anti-rotation member engaged with both the frac mandrel and the tubing spool to prevent movement of the frac mandrel with respect to the tubing spool. In one embodiment, the frac mandrel may be inserted into the tubing spool, the split retaining ring may be assembled around the frac mandrel, an anti-rotation member set to engage the surface of the frac mandrel and the tubing spool, and the split retaining ring may be coupled to the tubing spool, thereby locking the frac mandrel to the tubing spool. Removal of the frac mandrel may be effectuated by uncoupling the split retaining ring assembly from the tubing spool and allowing the frac mandrel to be pulled from the tubing spool.

Various refinements of the features noted above may exist in relation to various aspects of the present invention. Further features may also be incorporated in these various aspects as well. These refinements and additional features may exist individually or in any combination. For instance, various features discussed below in relation to one or more of the illustrated embodiments may be incorporated into any of the above-described aspects of the present invention alone or in any combination. Again, the brief summary presented above is intended only to familiarize the reader with certain aspects and contexts of the present invention without limitation to the claimed subject matter.

BRIEF DESCRIPTION OF THE DRAWINGS

These and other features, aspects, and advantages or the present invention will become better understood when the following detailed description is read with reference to the accompanying drawings in which like characters represent like parts throughout the drawings, wherein.

DETAILED DESCRIPTION OF SPECIFIC EMBODIMENTS

One or more specific embodiments of the present invention will be described below. In an effort to provide a concise description of these embodiments, all features of an actual implementation may not be described in the specification. It should be appreciated that in the development of any such actual implementation, as in any engineering or design project, numerous implementation-specific designs must be made to achieve the developers' specific goals, such as compliance with system-related and business-related constraints, which may vary from one implementation to another. Moreover, it should be appreciated that such a development effort might be complex and time consuming, but would nevertheless be a routine undertaking of design, fabrication, and manufacture for those of ordinary skill having the benefit of this disclosure.

When introducing elements of various embodiments of the present invention, the articles "a," "an," "the," and "said" are intended to mean that there are one or more of the elements. The terms "comprising," "including," and "having" are intended to be inclusive and mean that there may be additional elements other than the listed elements. Moreover, the use of "top," "bottom," "above," "below," and variations of these terms is made for convenience, but does not require any particular orientation of the components.

Figure 1:
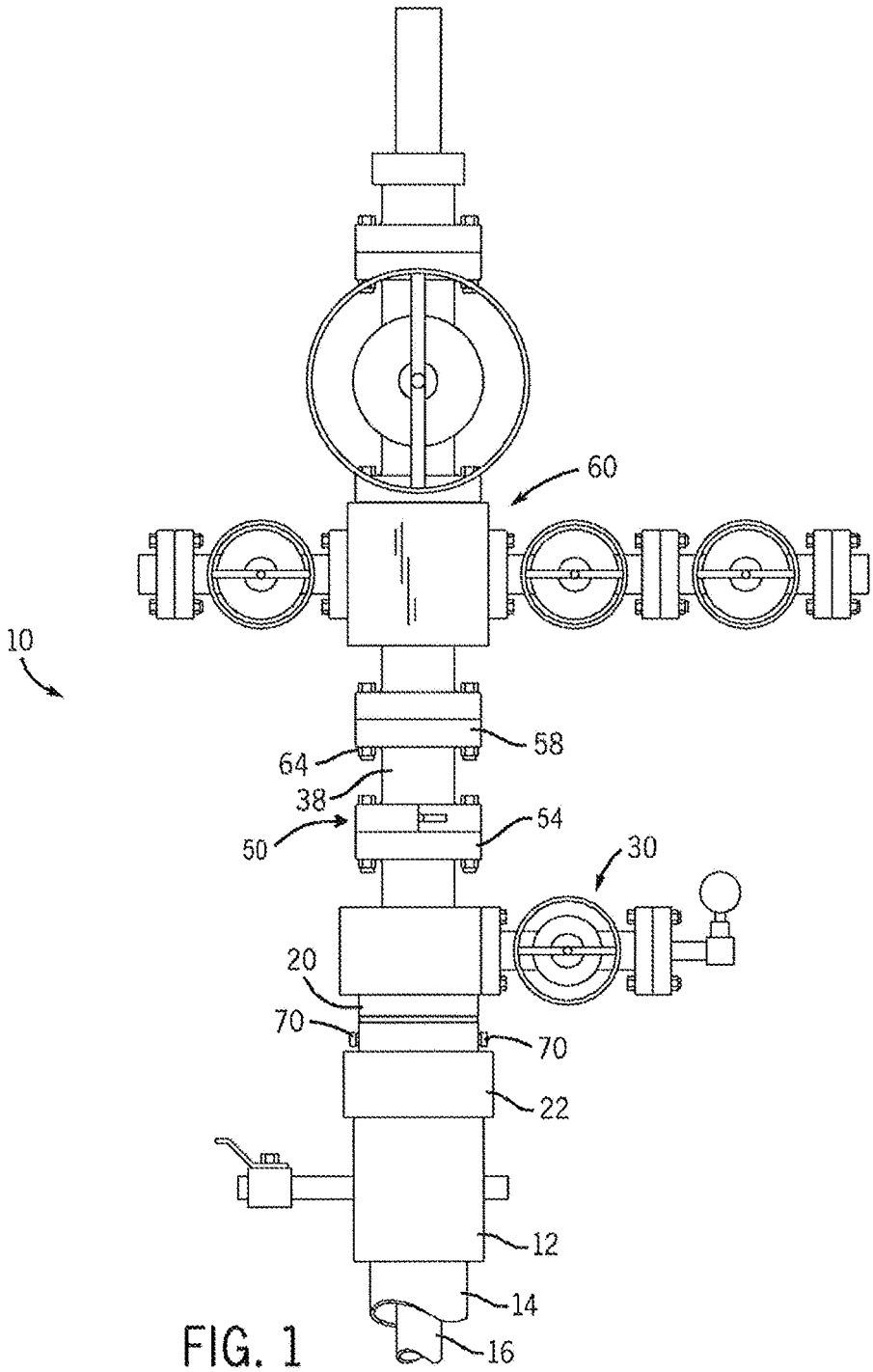
FIG. 1 is a front elevational view of a wellhead assembly having a frac mandrel coupled to a tubing spool via an exemplary locking assembly, in accordance with one embodiment of the present invention.
Figure 2:
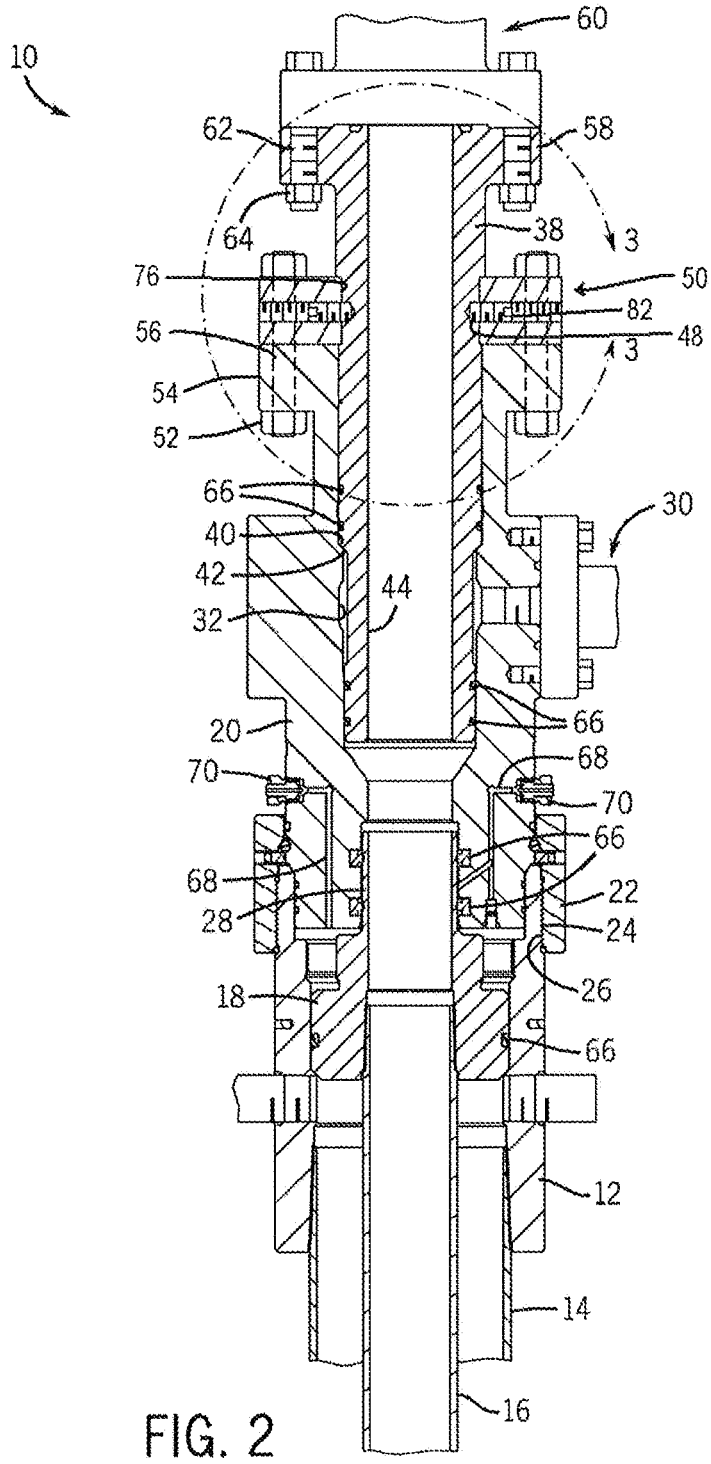
FIG. 2 is partial cross sectional view of the exemplary wellhead assembly of FIG. 1 illustrating the components of the wellhead assembly, in accordance with one embodiment of the present invention.

Turning now to the present figures, an exemplary wellhead assembly 10 is provided in FIGS. 1 and 2 in accordance with one embodiment of the present invention. The exemplary wellhead assembly 10 includes a casing head 12 coupled to a surface casing 14. The wellhead assembly 10 also includes a production casing 16, which may be suspended within the casing head 12 and the surface casing 14 via a casing hangar 18. It will be appreciated that a variety of additional components may be coupled to the casing head 12 to facilitate production from a subterranean well.

For instance, in one embodiment, a tubing head or spool 20 is coupled to the casing head 12. In the presently illustrated embodiment, the tubing spool 20 is coupled to the casing head 12 via a union nut 22. Of course, it will be appreciated that wellhead members, such as tubing spool 20, may be coupled to the casing head 12 in any suitable manner, including through the use of various other connectors, collars, or the like. In one embodiment, the tubing spool 20 may be adapted to receive an extended portion 28 of the casing hanger 18.

A valve assembly 30 is coupled to the exemplary tubing spool 20 and may serve various purposes, including releasing pressure from an internal bore 32 of the tubing spool 20. The internal bore 32 of the tubing spool 20 is configured to receive one or more additional wellhead members or components, such as frac mandrel 38 or a tubing hanger (not shown). As will be appreciated, operating pressures within the wellhead assembly 10 are typically greater during a fracturing process than during ordinary production. In order to protect components of the wellhead assembly 10 having a lower pressure rating (i.e., below the expected fracturing pressure) from such excessive pressure, the frac mandrel 38 may be introduced within the bore 32, to isolate the portions of the wellhead assembly 10.

The exemplary tubing spool 20 includes a landing shoulder 40 configured to abut a complementary landing shoulder 42 of the frac mandrel 38. In some embodiments, the landing shoulders 40 and 42 cooperate to position the frac mandrel groove 76 substantially above the tubing spool 20. The landing shoulder 40 of the tubing spool 20 typically supports a tubing hanger with a landing shoulder of its own. It will be appreciated that the frac mandrel 38 includes a bore 44 through which fracturing fluids may be injected into the well to facilitate future production.

In one embodiment, a split ring assembly 50 may be utilized to secure the frac mandrel 38 to the tubing spool 20, as discussed in greater detail below. The exemplary tubing spool also includes a flange 54 having a plurality of mounting apertures 56 to facilitate coupling of various components or wellhead members, such as additional valves or a "Christmas tree," to the tubing spool 20. The frac mandrel 38 may similarly include a mounting flange 58 to enable coupling of additional components to the frac mandrel 38. For instance, in the presently illustrated embodiment, a fracturing tree 60 is coupled to the flange 58 via studs 62 and nuts 64. The fracturing tree 60 or other additional components, however, may be coupled to the frac mandrel through other suitable methods in full accordance with the present techniques.

Turning to FIG. 2, the exemplary wellhead assembly 10 includes various seals 66 to isolate pressures within different sections of the wellhead assembly 10. For instance, as illustrated, seals disposed between the casing head 12 and the casing hangar 18, between the casing hangar 18 and the tubing spool 20, and between the tubing spool 20 and the frac mandrel 38 isolate various regions. Further, various components of the wellhead assembly 10, such as the tubing spool 20, may include internal passageways 68 that allow testing of one or more of the seals 66. When not being used for such testing, these internal passageways 68 may be sealed from the exterior via plugs 70.

Figure 3:
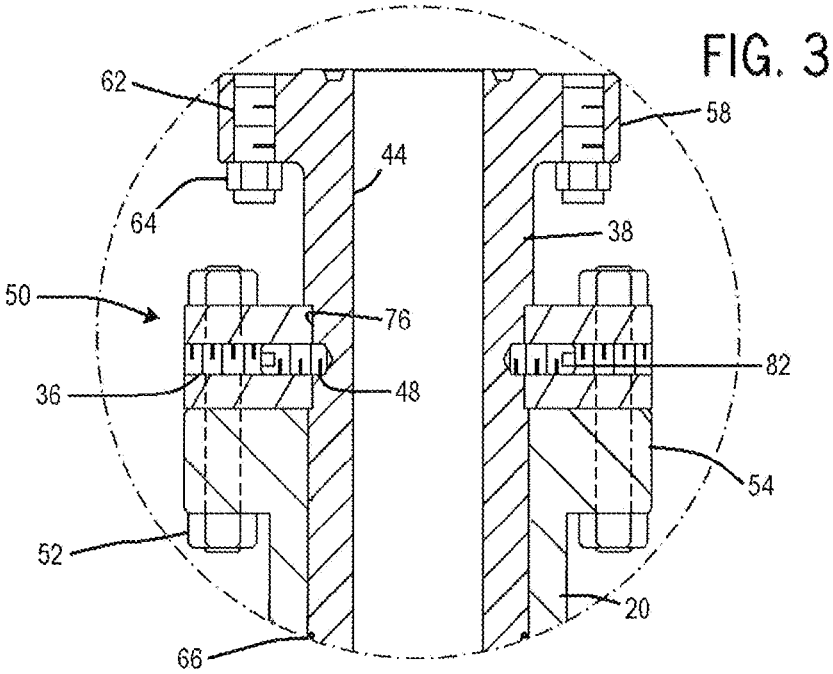
FIG. 3 is a detail view illustrating exemplary components of the split ring device of FIG. 2, in accordance with one embodiment of the invention.
Figure 4:
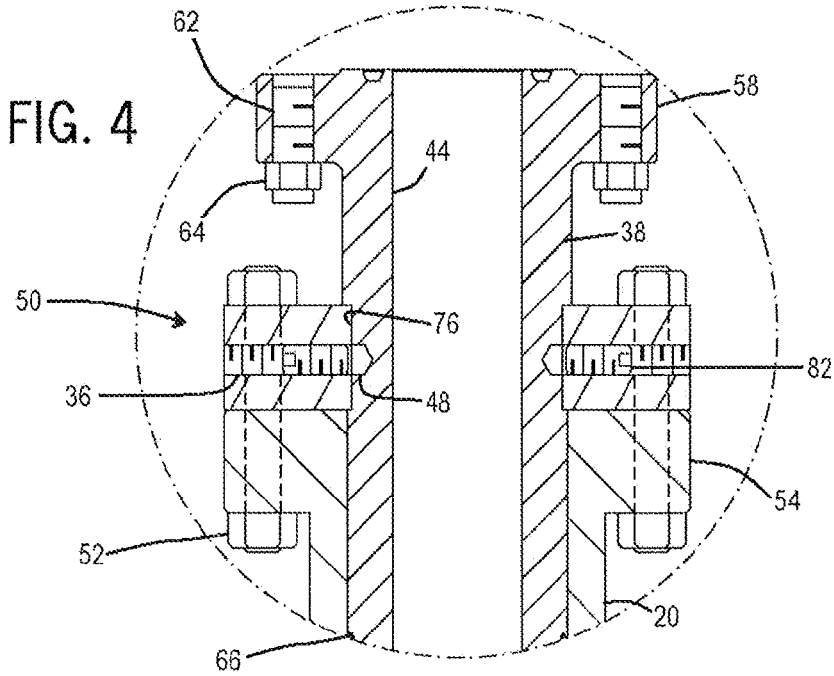
FIG. 4 is a detail view of the exemplary components of the split ring device in FIG. 3 in a disengaged configuration.
Figure 5:
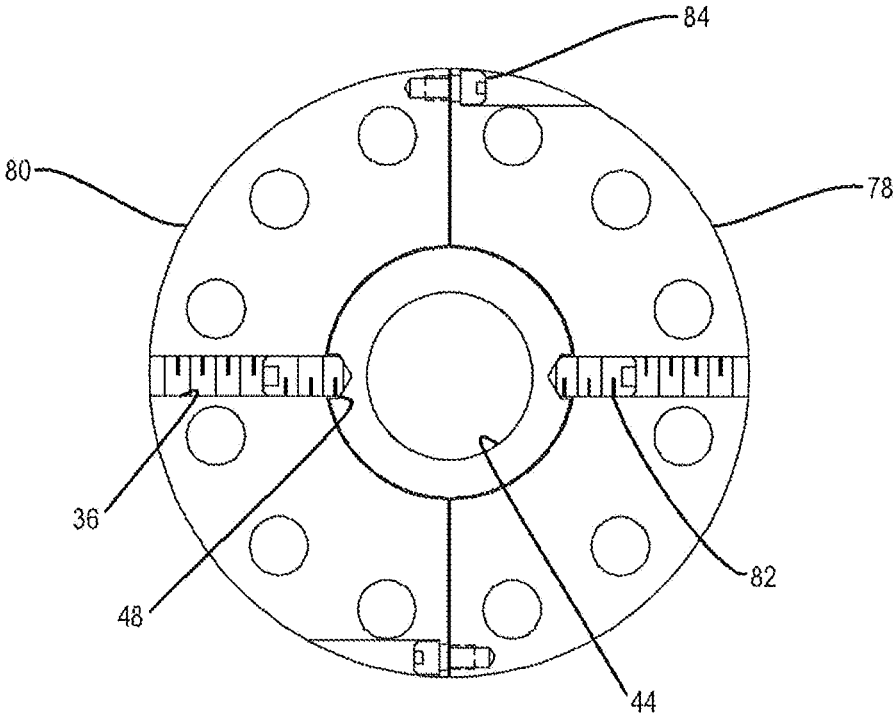
FIG. 5 is an axial cross-sectional view of the exemplary split ring device.

Operation of the split ring device 50, and an exemplary method for locking wellhead components to one another, may be better understood with reference to FIGS. 3-5. The exemplary split ring device includes a plurality of sections 78 and 80 configured to be coupled together around the frac mandrel 38 using connection mechanisms 84 as can been seen in FIG. 5. In addition to the connecting means, the exemplary split ring device also has anti-rotation members 82 configured to prevent rotational movement of the frac mandrel 38 relative to the tubing spool 20 once engaged. Notably, in the embodiment shown, once connected around the frac mandrel 38, the split ring device 50 is coupled to the flange 54 of the tubing spool 20 using a plurality of bolts 52. It will be appreciated that a variety of coupling means may be used to couple the split ring device 50 to the tubing spool flange 54.

In one embodiment, the split ring device is assembled around the frac mandrel 38 so that the split ring device 50 is at least partially disposed within the frac mandrel groove 76 preventing axial movement of the split ring device relative to the frac mandrel. It will be appreciated that a variety of engagement configurations may be used. Additionally, the anti-rotation members 82 are set to engage the anti-rotation notches 48 on the face of frac mandrel 50 and prevent rotational movement of the split ring device 50 relative to the frac mandrel 38. FIG. 3 illustrates one embodiment wherein the anti-rotation members 48 travel through the split ring sections via port 36 to engage the anti-rotation notch 48 on the face of frac mandrel 38. To better illustrate the configuration shown in FIG. 3, FIG. 4 shows the anti-rotation members 82 within the ports 36 but disengaged from the anti-rotation notches 48.

Once installed around the frac mandrel 38 and coupled to the tubing spool flange 54, the split ring inhibits substantial axial movement of the frac mandrel 38 with respect to the tubing spool 20. In addition, the anti-rotation members 82 engage the anti-rotation notches 48 surface of the frac mandrel 38 and prevent rotational movement of the frac mandrel 38 relative to the tubing spool 20. It should be noted that once fully connected, the exemplary split ring assembly 50 substantially inhibits both axial and rotational movement of the frac mandrel 38 relative to the tubing spool 20. It should also be noted that, through the use of split lock ring 50 in some embodiments, the frac mandrel 38 is locked to tubing spool 20 without using any lock screws. In at least one embodiment, the elimination of such lock screws may reduce or eliminate external penetrations into the bore 32 of the tubing spool 20, reduce the number of leak paths in the wellhead assembly 10, and exhibit increased operational safety.

While the invention may be susceptible to various modifications and alternative forms, specific embodiments have been shown by way of example in the drawings and have been described in detail herein. However, it should be understood that the invention is not intended to be limited to the particular forms disclosed. Rather, the invention is to cover all modifications, equivalents, and alternatives falling within the spirit and scope of the invention as defined by the following appended claims.5

The invention claimed is:

1. A wellhead system comprising:

a first wellhead component including an internal bore;

a second wellhead component comprising a lower end disposed within the first wellhead component internal bore and an upper end disposed outside of the first wellhead component internal bore, wherein the upper end of the second wellhead component has a groove disposed on an outer surface thereof; and a split ring comprising a plurality of sections, wherein a portion of the split ring is at least partially disposed in the groove on the second wellhead component, the split ring is coupled to the first wellhead component, and an anti-rotation mechanism engages both the split ring and the second wellhead component.

2. The wellhead system of claim 1, wherein the first wellhead component comprises a tubing spool.

3. The wellhead system of claim 2, wherein the first wellhead component includes a flange.

4. The wellhead system of claim 3, wherein the first wellhead component flange is coupled to the split ring through a plurality of bolts.

5. The wellhead system of claim 1, wherein the second wellhead component is configured to at least partially isolate the first wellhead component from pressures substantially at or above the pressure rating of the first wellhead component.

6. The wellhead system of claim 5, wherein the second wellhead component is a frac mandrel.

7. The wellhead system of claim 1, wherein the split ring is configured to prevent axial movement of the second wellhead component.

8. The wellhead system of claim 7, wherein the anti-rotation mechanism includes a set screw at least partially disposed within the split ring.

9. The wellhead system of claim 1, wherein the anti-rotation mechanism is configured to prevent rotational movement of the second wellhead component.

10. A wellhead system comprising:

a first wellhead component including an internal bore;

a second wellhead component comprising a lower end disposed within the first wellhead component internal bore and an upper end disposed outside of the first wellhead component internal bore, wherein the upper end of the second wellhead component comprises an engagement surface extending from an outer surface thereof; and a split ring comprising a plurality of sections, wherein a portion of the split ring abuts the engagement surface of the second wellhead component, the split ring is coupled to the first wellhead component, and an anti-rotation mechanism engages both the split ring and the second wellhead component.

11. The wellhead system of claim 10, wherein the first wellhead component comprises a tubing spool.

12. The wellhead system of claim 11, wherein the first wellhead component includes a flange.

13. The wellhead system of claim 12, wherein the first wellhead component flange is coupled to the split ring through a plurality of bolts.

14. The wellhead system of claim 10, wherein the second wellhead component is configured to at least partially isolate the first wellhead component from pressures substantially at or above the pressure rating of the first wellhead component.

15. The wellhead system of claim 14, wherein the second wellhead component is a frac mandrel.

16. The wellhead system of claim 10, wherein the split ring is configured to prevent axial movement of the second wellhead component.

17. The wellhead system of claim 10, wherein the anti-rotation mechanism is configured to prevent rotational movement of the second wellhead component.

18. The wellhead system of claim 17, wherein the anti-rotation mechanism includes a set screw at least partially disposed within the split ring.

19. A method comprising:

inserting a second wellhead component at least partially into an internal bore of a first wellhead component such that a groove in the second wellhead component is disposed substantially outside of the first wellhead component internal bore; and securing the second wellhead component to the first wellhead component, wherein securing the second wellhead component to the first wellhead component comprises:

installing a split ring around the second wellhead component so that a portion of the split ring is at least partially disposed within the groove in the second wellhead component;

coupling the split ring to the first wellhead component; and engaging the outer surface of the second wellhead component with at least one anti-rotation mechanism.

* * * * *